United States Patent [19]

Hack et al.

[11] Patent Number: 4,850,576

[45] Date of Patent: Jul. 25, 1989

[54] HEAT TREATMENT OF MATERIALS

[75] Inventors: Robert Hack, Lahnau; Ralf Peter, Haiger; Wilhelm Polhede, Bruchkuebel, all of Fed. Rep. of Germany

[73] Assignee: Arthur Pfeiffer Vakuumtechnik Wetzlar GmbH, Fed. Rep. of Germany

[21] Appl. No.: 64,207

[22] Filed: Jun. 18, 1987

[30] Foreign Application Priority Data

Jul. 1, 1986 [DE] Fed. Rep. of Germany ..... 3621996

[51] Int. Cl.[4] ..... C21D 9/00

[52] U.S. Cl. ..... 266/208; 266/280

[58] Field of Search ..... 266/207, 208, 280, 286, 266/287, 283, 209

[56] References Cited

U.S. PATENT DOCUMENTS

| | | | |
|---|---|---|---|
| 4,208,043 | 6/1980 | Sieurin | 266/286 |
| 4,235,592 | 11/1980 | Smith, Jr. | 266/286 |
| 4,332,552 | 6/1982 | Seelandt | 432/209 |
| 4,398,702 | 8/1983 | Lueth | 266/208 |

FOREIGN PATENT DOCUMENTS

| | | |
|---|---|---|
| 852457 | 11/1960 | United Kingdom . |
| 1425329 | 2/1976 | United Kingdom . |
| 1537562 | 12/1978 | United Kingdom . |

*Primary Examiner*—S. Kastler

*Attorney, Agent, or Firm*—Toren, McGeady & Associates

[57] ABSTRACT

In an installation for the vacuum heat treatment and subsequent hot isostatic redensification of materials comprising a work space inside a container, heating unit, work-space insulation and an outer chamber with a vacuum connection and a pressure-gas connection, insulation is also provided at the interior of the chamber wall. The chamber is water-cooled.

2 Claims, 2 Drawing Sheets

HEAT TREATMENT OF MATERIALS

BACKGROUND OF THE INVENTION

The invention relates to an installation for the heat treatment of material, for example vacuum heat treatment and subsequent hot isostatic after-treatment.

The basic principle of such an installation is described for example in DE No. 30 14 691 and in U.S. Pat. No. 4,398,702.

In a vacuum furnace, which is simultaneously designed for the application of pressure, the following method steps take place in succession, for example during the sintering of hard metal:

The parts preshaped from powder and held together by a binding agent are heated under vacuum until the binding agent escapes. This operation is called dewaxing. In the second method step, the parts are sintered at an elevated temperature. Then a further improvement in the mechanical properties of the sintered compacts is achieved by hot isostatic redensification.

Such methods and installations for carrying them out are known and belong to the prior art. They are described, for example, in the above-mentioned patents.

During the carrying out of such methods, however, problems arise which are not satisfactorily solved in the known installations. For example, since the hot isostatic redensification take place under high pressure and a high temperature, particular importance is attached to the insulation between the hot work space and the cold chamber wall. This insulation plays an important part with regard to the constancy of temperature, the energy consumption and the operational reliability. In addition, it must, on the one hand, be practically gastight in order to prevent the escape of hot gas but on the other hand it must be able to be evacuated satisfactorily for the vacuum operation.

The heat transfer from work space to the chamber-wall is effected basically by heat conduction, convection and radiation. In vacuum operation, the heat transfer is effected solely by radiation and by heat conduction by solid components. During operation with protective gas, there is also the heat conduction of the gas and, with increasing pressure, also a corresponding heat transport by convection. This means that increasing pressure causes an increasing transport of heat to the chamber-wall. If this heat transport is not kept under control and reduced, disadvantageous effects occur. These are excessive temperatures of the chamber-wall, as a result of which the life and safety of the installation are negatively influenced, excessive energy loss and adequate homogeneity of temperature in the work space of the installation.

SUMMARY OF THE INVENTION

The present invention seeks to reduce the heat transport from the work space to the chamber-wall and to keep the wall's temperature within limits in order largely to eliminate the disadvantageous effects mentioned.

According to the present invention, there is provided an installation for the heat treatment of materials in a vacuum and under pressure, consisting of a work space, a container surrounding said work space, heating means, work-space insulation, and an outer chamber with a vacuum connection and a pressure-gas connection, wherein further insulation is provided at the inside of said chamber.

BRIEF DESCRIPTION OF THE DRAWINGS

A preferred embodiment of the present invention will now be described, by way of example only, with reference to the accompanying drawings, of which.

DESCRIPTION OF THE PREFERRED EMBODIMENT

Figure 1:
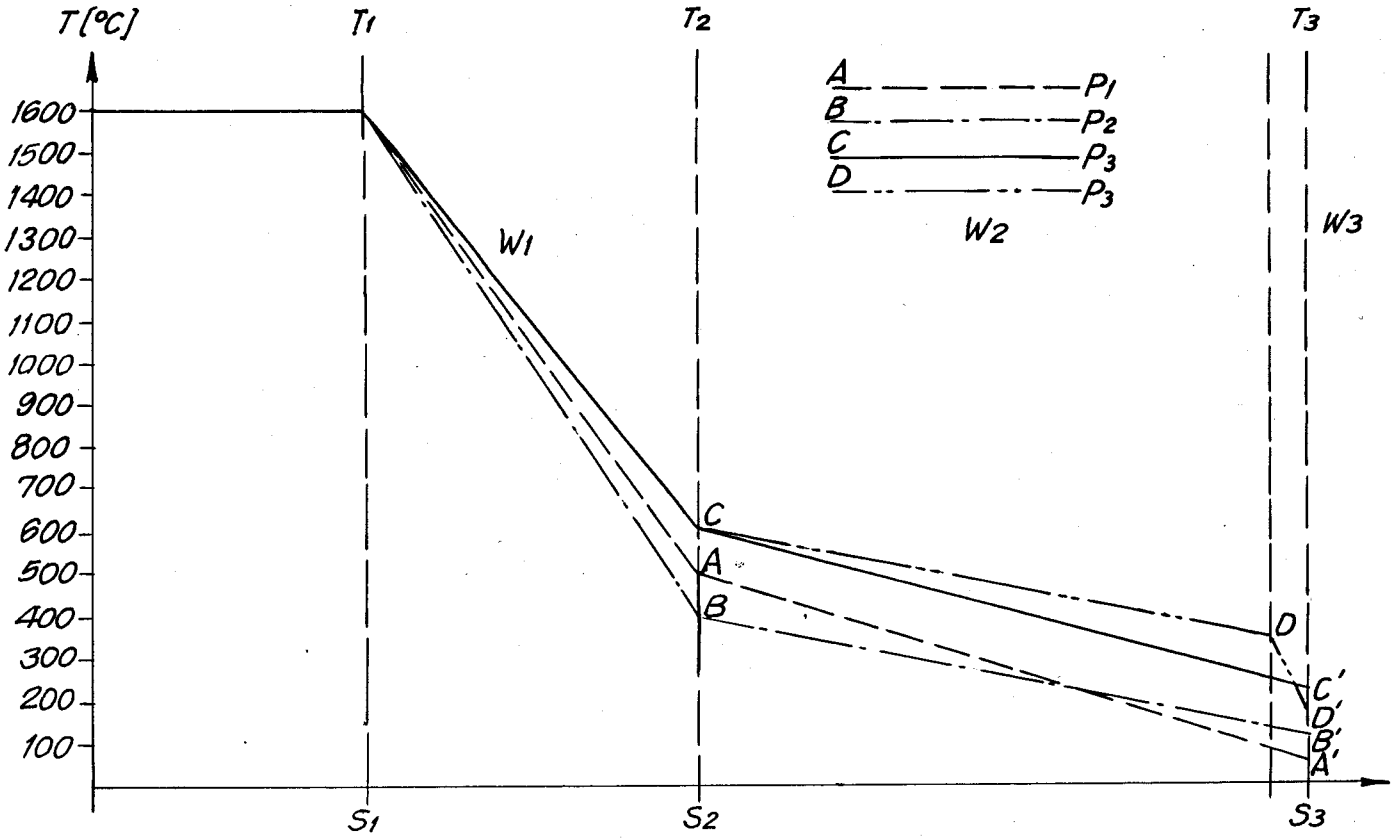
FIG. 1 shows a graph of temperature and heat transmission.

Basically, the present invention provides an installation for the heat treatment of materials in a vacuum and under pressure, consisting of a work space, a container surrounding the work space, heating means, work-space insulation, and an outer chamber with a vacuum connection and a pressure-gas connection, with insulation being provided at the inside of the chamberwall.

With the lining of the inner chamber-wall with an insulation preferably consisting of metallic foils and/or sheets, the effect is achieved that a great temperature drop occurs at this point. Thus the temperature at the chamber-wall can be kept low.

The insulation at particularly critical points is improved by providing an arrangement in which:

(a) the work-space insulation consists of panels of hard felt with graphite-sheet laminations impervious to gas on the side wall, the upper covering wall and on the end walls, and the upper edges and joints are covered wtih angle sections of carbon-fibre reinforced grapite so that gas-tightness is achieved, while the lower edges are open for evacuation, and (b) the angle sections consisting of carbon-fibre reinforced graphite are arranged, repeatedly alternating, between the panels of hard felt, so that a type of labyrinth seal is formed.

Particularly in the case of work spaces with an angular cross-section, the critical points occur at the edges and joints where two walls abut one another. At these interfaces, residual gaps occur which may become large in the course of the operating time and so cause defective insulation.

This disadvantageous effect can be prevented by covering the gaps. Difficulties are encountered there, however. From the shaping point of view, metal foils would be suitable for covering the corners and edges. Since the work-space insulation consists of graphite felt, however, a close-fitting covering would lead to chemical reactions and, in the event of heat expansion, to mechanical stresses as a result of which the function of the proposed measures would be put in question. These difficulties can be avoided if the same material as that of which the work-space insulation consists, namely graphite, is used for the covering.

Conventional graphite materials cannot be considered, however, since they are unsuitable for tight insertion in corners and edges because of their fragility.

In recent times, however, carbon-fibre reinforced graphite materials have been available which can be produced with any desired section. The use of angle sections of this material for covering residual gaps at corners and edges represents an optimum solution of the problems described above. If a plurality of these members are fitted between the various layers of the work-space insulation, a type of labyrinth seal is obtained and hence a further improvement in the insulation of the work space.

There are similar critical points at the end edges of the work-space insulation where the surfaces serving for the insulation are exposed to high wear as a result of frequent opening and closing. A permanent and reliable insulation is achieved by providing an arrangement in which the end edges of the work-space insulation and/or the opposite faces are edged with sections of carbon-fibre reinforced graphite.

Partitions may hamper convection and so reduce the heat transmission from the work-space insulation to the chamber-wall to the chamber-wall insulation. The partitions may comprise metallic material in the form of foils and/or sheets.

Additional cooling, e.g. water cooling, may be provided between the chamber-wall insulation and the chamber wall at the cover sides of the chamber. This is advantageous since the chamber cooling means may not be sufficient in the flange and cover region because of the great wall thickness.

Referring now to the drawings, the graph in FIG. 1 is intended to illustrate, by way of example, how the temperature curve and heat transfer from the work space to the chamber wall may appear under various operating conditions (vacuum $P_1$, in the region of a few bars $P_2$ and under high pressure $P_3$).

A constant temperature $T_1$ prevails in the work space under all operating conditions. The following conditions arise from the edge $S_1$ of the work space to the chamber wall $S_3$ depending on the particular operational state. In equilibrium, the amounts of heat drawn off $W_1$, $W_2$ and $W_3$ are equal.

Vacuum ($P_1$=reduced pressure range): Inside the workspace insulation, the amount of heat $W_1$ is transmitted from $S_1$ to $S_2$ by heat conduction of the insulation material. The temperature $T_2$ assumes the value A. The further heat transport to $S_3$ is effected substantially only by radiation. At the point $S_3$, the temperature $T_3$ assumes the value A'.

Under pressure ($P_2$ =in the range of a few bar): The transmission of heat from $S_1$ to $S_2$ is effected by heat conduction of the insulation material and of the gas contained therein and by convection. $T_2$ assumes the value B. The heat is transmitted to $S_3$ by radiation, by heat conduction of the gas and by convection.

The temperature $T_3$ rises to B'. B' is higher than A' because in this case the amount of heat transported from $S_2$ to $S_3$ is greater, by the amount due to the influence of the gas, than in the comparative case, vacuum. Therefore, the point B is also lower than the point A at the position $S_2$. As a result of the fact that more heat is transmitted from $S_2$ to $S_3$, the temperature $T_2$ drops.

Under high pressure ($P_3 >> P_2$): The heat transmission from $S_1$ to $S_2$ is effected, as in the preceding case, by heat conduction of the insulation material and of the gas and by convection. $T_2$ assumes the value C. The heat in transmitted between $S_2$ and $S_3$ by radiation, by heat conduction of the gas and by convection. Since the convection at high pressure plays a large part in this case, the temperature $T_3$ at $S_3$ rises considerably to the value C'.

In all three cases, the temperature $T_3$ is additionally dependent on the amount of heat $W_3$ which is conveyed out of the chamber wall to the outside.

As a result of the lining of the inner wall of the chamber with an insulation preferably consisting of metallic foils and/or sheets, the effect is achieved that the convection is reduced in front of the chamber wall and so a high temperature gradient results, as a result of which the temperature in front of the chamber-wall insulation at first assumes the value D and then drops towards the chamber wall to a value D' which is distinctly below the value C'.

Where:

(a) the work-space insulation consists of panels of hard felt with graphite-sheet laminations impervious to gas on the side walls, the upper covering wall and on the end walls, and the upper edges and joints are covered with angle sections of carbon-fibre reinforced graphite so that gas-tightness is achieved, while the lower edges are open for evacuation; and/or (b) the angle sections consisting of carbon-fibre reinforced graphite are arranged, repeatedly alternating, between the panels of hard felt, so that a type of labyrinth seal is formed: and/or (c) the end edges of the work-space insulation and/or the opposite faces are edged with sections of carbon-fibre reinforced graphite;

the amount of heat transmitted from the work space to the remaining volume of the chamber by convection is reduced.

By providing partitions (e.g. of metallic material in the form of foils of sheets) as barriers between the work-space insulation and the chamber-wall insulation, the proportion of the amount of heat transmitted $W_2$ which is due to convection, is reduced. The effect of this is a lowering of the temperature C' (without chamber-wall insulation) and of the temperatures D and D' (with chamber-wall insulation).

By providing additional water cooling between the chamber wall insulation and the chamber wall and in particular at the upper half of the chamber in a flange and cover region thereof, the chamber temperatures in the flange and cover region are lowered by the improved heat dissipation.

Figure 2:
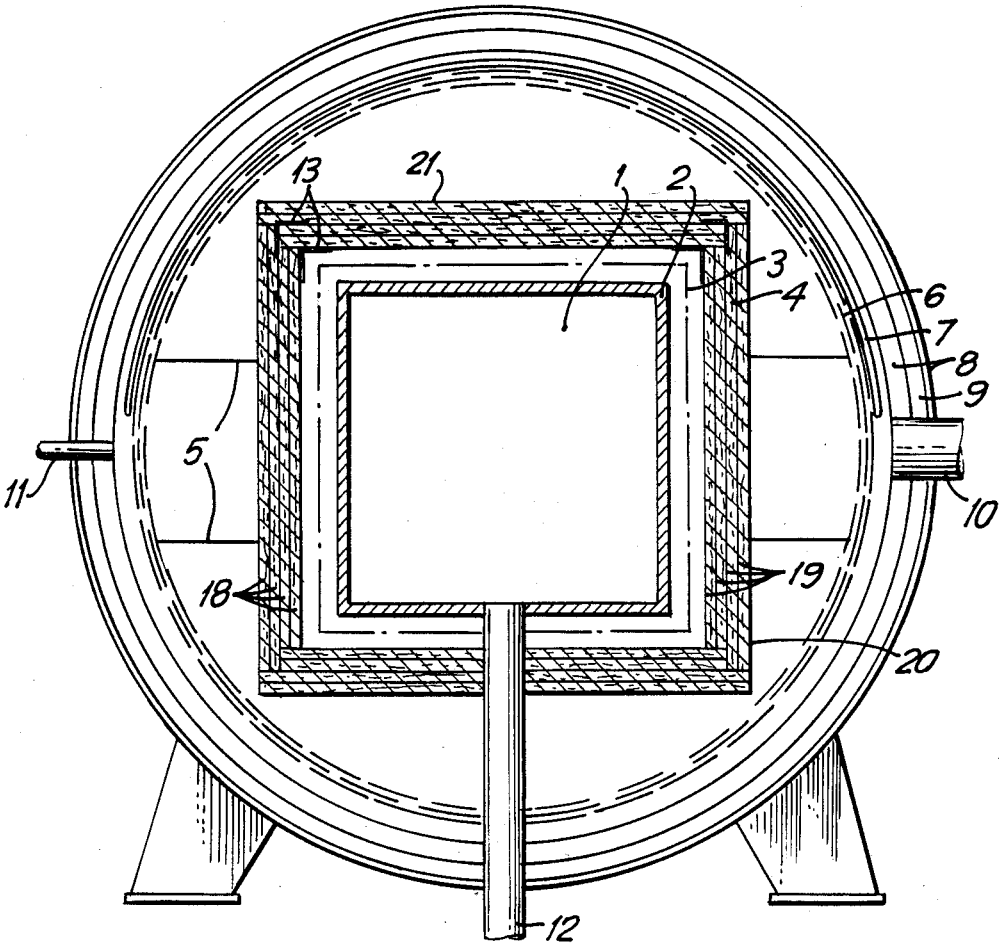
FIG. 2 shows a diagrammatic cross-section through an installation according to the invention.
Figure 3:
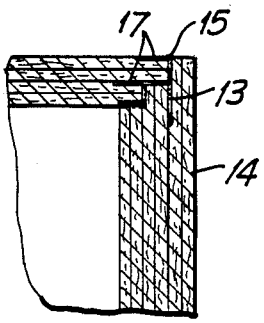
FIG. 3 shows a detail of a diagrammatic longitudinal section of the work-space insulation at an upper end edge.

In FIG. 2, there is shown a diagrammatic crosssection of an installation according to the invention, which is made horizontal in this example. In FIG. 3 there is shown a detail of a diagrammatic longitudinal section of the work-space insulation at an upper end edge. In these, 1 designates the work space, 2 the container, 3 the heating, 4 the work-space insulation, 5 the convection partitions, 6 the chamber-wall insulation, 7 additional cooling, 8 the chamber wall, 9 the chamber cooling, 10 the vacuum connection, 11 the pressure-gas connection and 12 the dewaxing connection, 13 angle sections of carbon-fibre reinforced graphite, 14 the end wall of the work-space insulation, 15 end edges, 17 sections of carbon-fibre reinforced graphite, 18 panels of hard felt, 19 graphite-sheet lamination, 20 the side walls of the work-space insulation and 21 the upper covering wall of the work-space insulation.

It will be understood that the above description of the present invention is susceptible to various modifications, changes and adaptations.

What is claimed is:

1. An installation for the heat treatment of materials in a vacuum and under pressure, consisting of a work space, a container surrounding said work space, said container comprising sidewalls, an upper covering wall and end walls, heating means for heating said container, work-space insulation surrounding said container and consisting of panels of hard felt with graphite-sheet laminations impervious to gas on said walls, and upper edges and joints of said panels being covered with angle sections of carbon-fiber reenforced graphites, so that gas-tightness is achieved, while the lower edges of said panels are open for evacuation, said angle sections being arranged, repeatedly alternating, between said panels of hard felt, to form a labyrinth seal, an outer chamber surrounding said work-space insulation, said chamber having a vacuum connection and a pressure-gas connection, and chamber-wall insulation between said work-space insulation and said chamber and provided at the inside of said chamber and spaced outwardly of said work-space insulation, said chamber-wall insulation consisting of metallic material in the form of at least one of foils and sheets, said outer chamber being water-cooled and additional water cooling being provided between said chamber-wall insulation and the wall of said chamber, said chamber having a flange and a cover region and said additional water cooling being provided at an upper half of said flange and cover region.

2. An installation for the heat treatment of materials in a vacuum and under pressure, comprising a work space, a container surrounding said work space, heating means for heating said container, work-space insulation surrounding said container, an outer chamber surrounding said work-space insulation, said chamber having a vacuum connection and a pressure-gas connection, chamber-wall insulation between said work-space insulation and said chamber and provided on an inside of said chamber and substantially along the inside of said chamber, said chamber-wall insulation being spaced outwardly of said work-space insulation, said container comprising sidewalls, an upper covering wall and ends walls, and said work-space insulation comprising sidewalls, end walls, an upper wall, and a bottom wall, said side, and an upper walls of said work-space insulation each comprise a plurality of panels of hard felt with graphite-sheet laminations which are impervious to gas, said side and end walls of said work-space insulation being connected at joints to side edges of said upper wall, each of said joints comprising angle sections of carbon-fiber reinforced graphite only in the area of said joints to render said joints gas-tight, said side and end walls each having lower edges for engagement with said bottom wall for permitting open evacuation of the interior of said work-space insulation, each of said joints comprising carbon-fiber reinforced graphite extending over at least one of edges of said side and end walls and opposite facing surfaces of said upper wall only in the area of said joints, said joints comprising angle sections of carbon-fiber reinforced graphite arranged to be repeatedly alternating between said panels of hard felt form a labyrinth seal, said installation including a plurality of partitions forming convection barriers between said work-space insulation and said chamber-wall insulation for reducing convection in a space between said workspace insulation and said further insulation, and cooling means for cooling said outer chamber, said cooling means comprising water cooling means around an exterior of said chamber, said chamber having flange and cover regions, said cooling means including additional water cooling means extending over an upper half of said flange and cover regions.

* * * * *